United States Patent [19]

Vasseur

[11] 4,163,595

[45] Aug. 7, 1979

[54] ELECTRICAL SUPPLY DEVICE

[75] Inventor: Bernard Vasseur, Lamotte-Beuvron, France

[73] Assignee: LITA, Lamotte-Beuvron, France

[21] Appl. No.: 851,803

[22] Filed: Nov. 15, 1977

[30] Foreign Application Priority Data

Nov. 19, 1976 [FR] France ..... 76 34918

[51] Int. Cl.[2] ..... H01R 13/54; H01R 13/64

[52] U.S. Cl. ..... 339/88 R; 339/22 B

[58] Field of Search ..... 339/22 R, 22 B, 39,75 M, 339/82, 88 R

[56] References Cited

U.S. PATENT DOCUMENTS 3,613,045 10/1971 Routh et al. ..... 339/22 BX 3,933,403 1/1976 Rubesamen et al. ..... 339/22 R 3,963,294 6/1976 Heritage ..... 339/22 R

*Primary Examiner*—E. F. Desmond

*Attorney, Agent, or Firm*—Cushman, Darby & Cushman

[57] ABSTRACT

An electrical supply device including a conductor rail on which a sliding adapter providing a connection between the conductors of the rails and an user apparatus is readily positioned, the rail having an asymetrical profile with slideways situated in two different and parallel planes in which the adaptor, by means of a system of guides, may slide. The adaptator has a head carrying contacts, whose dimensions and geometry allow it to be introduced into the rail at an angle of 90° to the longitudinal axis of the rail, and to pivot only in a given direction. Before pivoting that, the whole adapter is slidable along the rail and can then be locked in any selected position.

7 Claims, 4 Drawing Figures

ELECTRICAL SUPPLY DEVICE

Figures 1A, 1B:
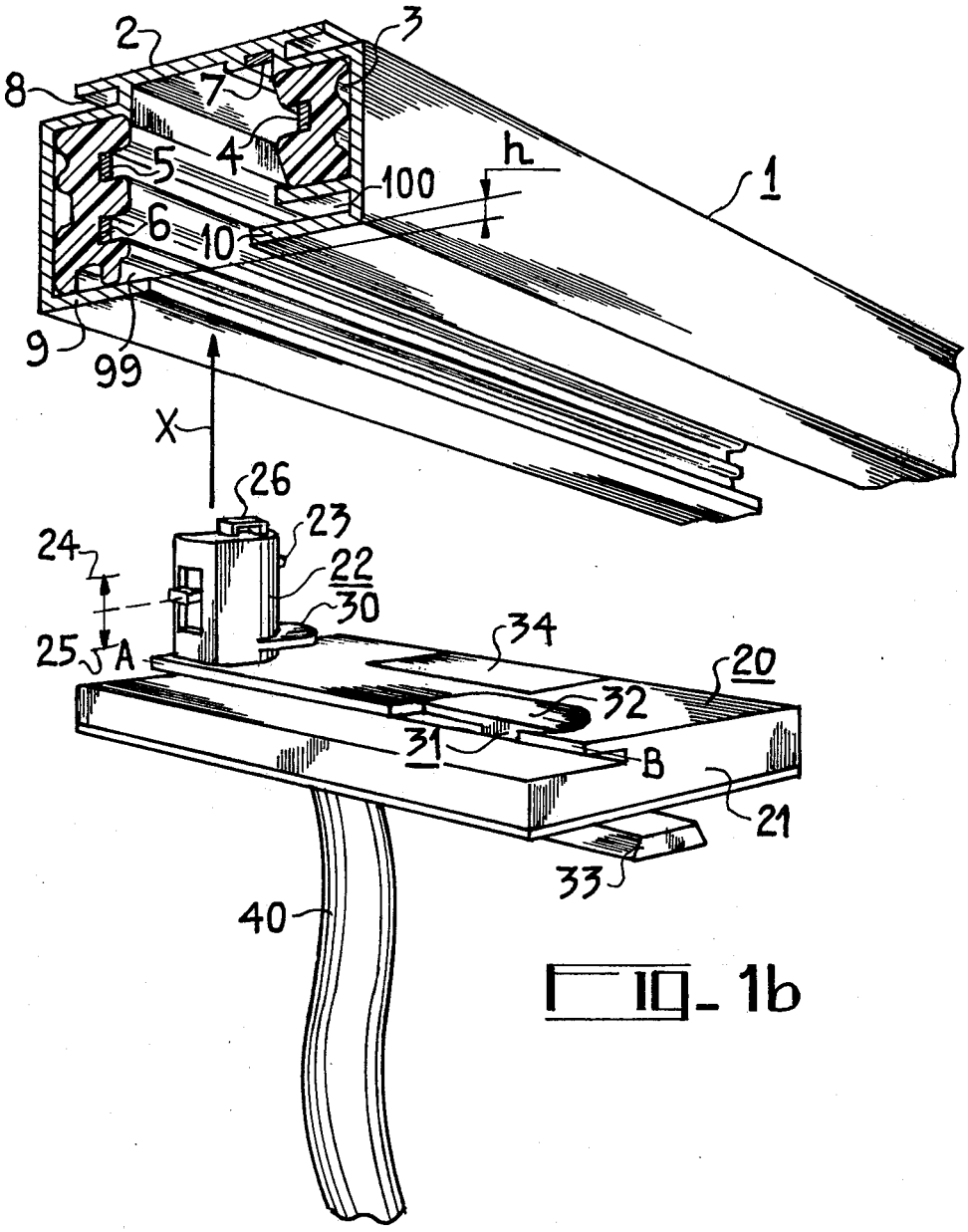

The present invention relates to an electrical supply device and more particularly to a lighting assembly including a conductor rail with a sliding adapter providing a connection between the conductors of the rail and a lighting apparatus. The adapter may readily be positioned at any location along the length thereof and securely yet releasably locked at any selected location with a relatively simple manipulation.

Electrical supply devices including a conductor rail are generally made up by joining together a number of modules comprising essentially a metallic channel in which are inserted conductor wires partly embedded in an insulating sheath, and to which voltage can be applied. The user apparatus for example, lighting apparatus, can be connected anywhere along the rail, the electrical connections being then provided by a sliding adapter. This adapter includes, on the one hand, means for forming a mechanical connection to the rail and, on the other hand, electrical connecting means in the form of contacts capable of being connected to the conductor wires. The fitting of accesories and of adaptors must be easy to achieve. It should not be necessary for the user to ponder for a longtime before deciding which way round the various parts have to be fitted together. For this purpose the majority of rails, fittings and adaptors are provided with fool-proofing devices which facilitate the assembly operation.

One object of the present invention is to provide a conductor rail in which it is the outline shape of the rail which performs the fool-proofing functions. More particularly, it relates to an electrical rail for forming a movable connection to user apparatus of the type comprising a channel in which are inserted conductors embedded in an insulating sheath, which is characterised in that the said channel includes slideways which are situated in two different and parallel planes which are separated from one another by a predetermined distance. According to the invention, the rail has then an asymetrical profile which makes it unnecessary for fool-proofing devices to be used. Another object of the invention is to provide an adaptor specially designed to co-operate with said asymetrical rail having also an asymetrical profile and capable of being located in the slideways of the rail. Another object of the invention is to provide a combination of said asymetrical rail and adaptor capable of obviating any danger of accidental or incorrect application of voltage. Another object of the invention is to provide an above mentioned combination which may be miniaturized and produced with the minimum of moving parts and sophisticated locking systems which considerably increase the manufacturing cost.

The invention relates to an electrical supply device including a conductor rail on which an electrical supply device is located between conductors inside the rail and an user apparatus, wherein said rail comprises a channel in which insulated conductors are inserted and asymetrical slideways situated in two different and parallel planes and wherein said adapter is a housing comprising: a flat part including a system of guides intended to be located and slid in said slideways; a head carrying contacts, having an axis vertical relative to the axis of said flat part, said head including guiding means for allowing it to be introduced into the rail at an angle of 90° to the longitudinal axis of the rail, to pivot within the rail only in a given direction; said housing further comprising means for locking said adaptor to said rail in a selected position.

Figure 2:
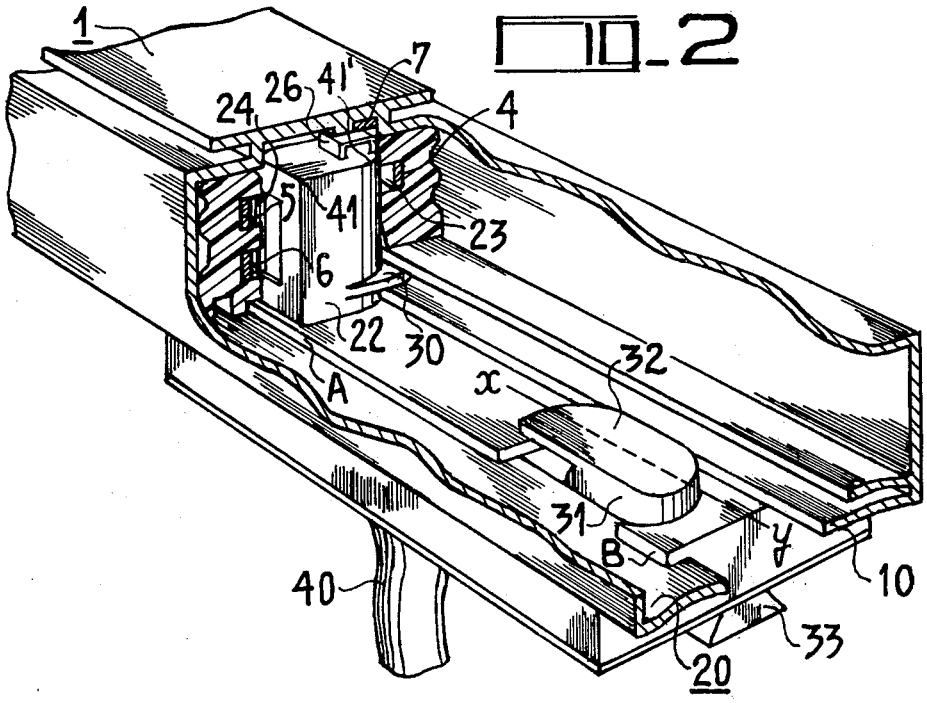
Figure 3:
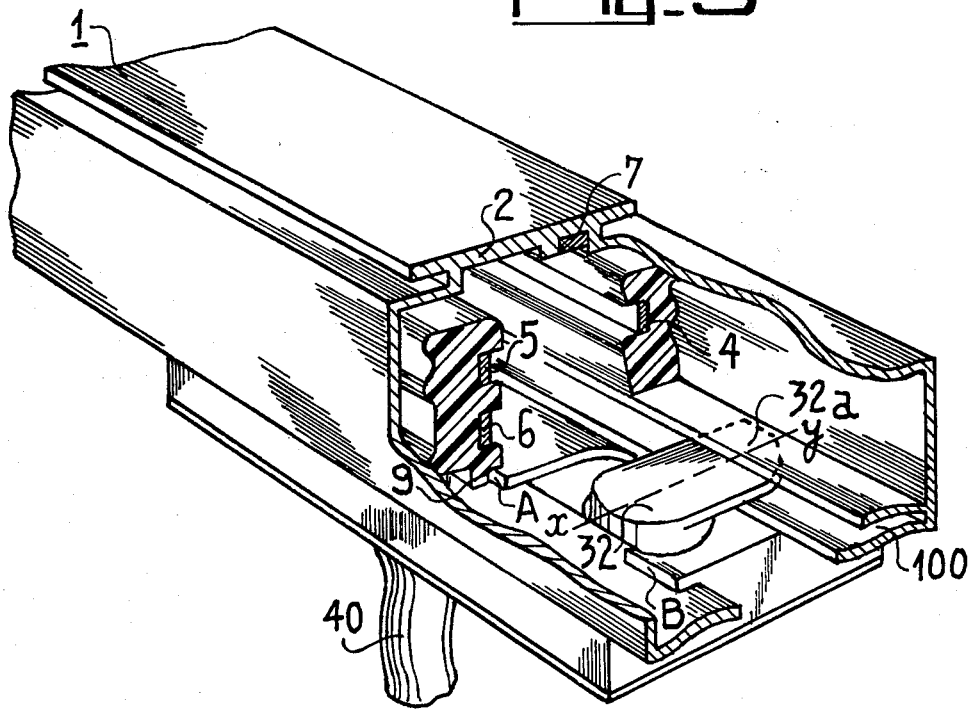

The invention will be better understood from the following explanation and from the accompanying drawing, in which:

FIG. 1 is a schematic view of a rail, shown in part (a) which is particularly adapted to receive an adapter according to the invention such as is shown in part (b) of the Figure, FIG. 2 shows the adapter in one of the phases of its engagement in the rail, FIG. 3 shows a part of the adapter when the mechanical and electrical connections have been made.

In all Figures similar components bear the same reference numerals.

FIG. 1 shows, schematically, the rail 1 which is particularly adapted to co-operate with an adapter according to the invention. This rail 1 is formed by a channel 2 made, for example, of anodised aluminum, by extrusion, and through which extends a sheath 3 made of polyvinylchloride. Conductors are inserted in the insulating sheath 3. They are three in number in the embodiment being described. Conductor 4 represents the neutral of the supply and conductors 5 and 6 represent the first and second phases respectively of the supply. At a point 7, the rail includes a tinned copper conductor which is provided as an earth connection in conformity with existing regulations. An attachment recess 8 enables the rail to be fitted to the surface intended to receive it, which may be a floor, a ceiling, a partition, etc. At least two locating flanges 9 and 10 are provided and define slideways 99 and 100 intended to receive guides provided on the adapter. The outline of these two flanges is suited to each particular application but they both preferably have one essential characteristic, namely that of being asymmetrical. This asymmetry is more clearly demonstrated in FIG. 1 (a) by reference h which clearly shows that the two flanges 9 and 10 do not lie in the same plane. This arrangement has a dual advantage. On the one hand it avoids the need for a fool-proofing device to be provided as in the case of the majority of rail systems presently known. This asymmetrical configuration does, in fact, perform the function in question by itself. On the other hand such an arrangement assists in the co-operation between the rail and the adapter according to the invention, as will be explained below.

Part (b) of FIG. 1 is a schematic view of an adapter 20 according to the invention in the position which it has to occupy in relation to the rail, just before it is inserted in the rail and during the first phase of engagement. It has in fact to be inserted at an angle of 90° to the longitudinal axis of the rail. The arrow X represents the movement of the adapter towards the rail.

The adapter 20 incorporates a number of means which cooperate with one another to obviate any risk of mistakes or of an electrical connection being made accidentally. The adapter comprises, essentially, a housing having a relatively flat part 21 and, above it, a contact carrying head 22 whose axis is perpendicular to the axis of the flat part. In the embodiment being described, this head contains three contacts, namely a first contact 23 intended to be connected to the neutral, a second which is able to occupy two positions: a high position (when it carries the reference 24) and a low position (when it carries the reference 25) intended respectively to be connected to the first and second phases and a third contact 26 which is intended to be connected to earth.

A pre-selector system incorporated in the contact carrying head enables the phase which is to be used to be selected before the adapter, is inserted in the rail. This may, for example, be a guide which enables the contact to be made to slide either in the high position or the low position.

The flat part 21 of the adapter 20 incorporates a system of guides intended to be engaged in the slideways in the rail and a locating and attachment member. It is, for example, provided with a guide 30 situated at the point where it joins the head, which guide is capable of engaging in one of the slideways for connection to the rail and thus provide a first point for guidance and mechanical connection between the adapter and the rail.

The flat part of the adapter 20 also includes a locating and attachment member which has a lug 32 and a handle 33 which are connected together by a shaft 31. This attachment member is able to occupy two positions in a vertical plane, namely a release position and a locking position the purposes of which will be more clearly described further on in the description. In FIG. 1 it is shown in the release position. A fuse (not shown in the Figure) may be provided in the housing and preferably in its flat part, being accessible from the outside by means of a small flap 34.

A groove is formed for practically the entire length AB of the flat part of the adapter. It enables the whole of this length the said housing to slide along in one of the slideways of the rail. The guide system of the adapter, consisting of groove 35, lug 32 of the attachment member, and the guide 30, co-operates with the slideways of the rail, which lie in two different planes, to ensure that the adapter is well supported mechanically when it is engaged in the rail. The electrical connections are formed in the conventional fashion between the various contacts, and possibly the fuse, to supply an output supply-lead 40 intended for connection to the user apparatus, which is not shown in the Figure.

As stated above, the adapter, at the time when it is being engaged in the rail, has to be offered up at an angle of 90° to the axis of the adapter. When the contact carrying head 22 is inside the rail, the adapter is pivoted through 90° and it then assumes the position shown in FIG. 2. The outline of the contact carrying head is such that it has two rounded edges and two sharp edges symmetrically opposed to one another. One of the sharp edges, referenced 41, can be seen in the Figure as also can one of the rounded edges 40.

The dimensions and geometry of the head allow it to be inserted in the rail at an angle of 90° to the longitudinal axis of the rail, to be pivoted in the rail in one only predetermined direction, in the right direction, and the entire housing then to be slid along. If the housing is the wrong way round at the time of insertion, it is impossible to turn the contact carrying head and thus to make the mechanical attachment and the electrical connection. This is a considerable advantage, in that any danger of accidential or incorrect connection is avoided. Contact 26 (the earth) is the first to connect with its conductor 7, as required by existing regulations. Contact 23 is next connected, with no possibility of error, to the conductor 4 representing the neutral of the supply. At this stage in the engagement process, guide 30 comes into position in slideway 100. The locating and attachment member is in the release position (FIG. 2), that is to say the axis x, y of flange 32 coincides with, or is parallel to the longitudinal axis of the rail. This being the case, the adapter is able to slide along slideways 99. The guide means operate independently of one another. The adapter according to the invention may be made of a material which can be ultrasonically welded. This being the case a completely closed housing can be formed.

The locating and fixing member may be associated with a switch which makes the device described above even more versatile in use.

There are many possible applications for the rail and adapter combination according to the invention, in particular in the lighting field where it can be used for inexpensive installations which are easy to fit.

What is claimed is:

1. An electrical supply device for connecting electricity to a user apparatus comprising:

a plurality of insulated conductor wires partially embedded in an insulating sheath;

a rail having a metallic channel for receiving said wires at the periphery thereof, said channel having asymmetrical slideways situated in two different and parallel planes;

a sliding adapter having a flat part with guide means adapted to slidably engage said slideways for movement along said rail and along a longitudinal axis, means for locking said adapter to said rail in a selected position and a head part mounting a plurality of contacts and dimensioned for movement into said channel in a first orientation and thereafter, upon a pivot of 90° in a given direction about an axis perpendicular to said longitudinal axis, bringing said contacts and wires into electrical connection, said guide means being formed by a groove extending along said flat part for a length substantially equal to the length of said flat part and a guide formed at the region of the junction between said head and flat parts, said groove and guide engaging respective ones of said slideways.

2. An electrical supply device according to claim 1 wherein the disposition of said conductor wires is asymmetrical.

3. An electrical supply device according to claim 1 wherein said means for locking said adapter to said rail comprises a lug and an actuating handle which are connected together by a shaft, said locking means being capable of movement between a locking and a release position.

4. An electrical supply device according to claim 3 wherein said means for locking said adapter is in said release position when the axis of the lug coincides with or is parallel to the longitudinal axis of the rail when the adapter is sliding along said slidways.

5. An electrical supply device according to claim 3 wherein said means for locking said adaptor to said rail is in the locking position when the axis of the lug is perpendicular to the longitudinal axis of the rail, thus causing a part of the lug to engage in the same slidway as said guide and to support the adapter in the rail over its length on one side and at two different points on the other side.

6. An electrical supply device according to claim 1 wherein said head part has two rounded edges and two sharp edges opposed to each other which cooperate to permit movement only in said given direction.

7. An electrical supply device according to claim 1 wherein said head comprises at least one earth contact, a contact corresponding to the neutral of the three phase network and a supply contact which can occupy either of two positions, the first corresponding to one of the phases and the second to the other phase.

* * * * *